US007533427B2

(12) United States Patent
Jackson

(10) Patent No.: US 7,533,427 B2
(45) Date of Patent: May 19, 2009

(54) PANELIZED BED CLOTHING SUSCEPTIBLE OF HOME LAUNDERING

(75) Inventor: Tami L. Jackson, Appleton, WI (US)

(73) Assignee: Tami Jackson, De Pere, WI (US)

( * ) Notice: Subject to any disclaimer, the term of this patent is extended or adjusted under 35 U.S.C. 154(b) by 0 days.

(21) Appl. No.: 11/893,270

(22) Filed: Aug. 14, 2007

(65) Prior Publication Data

US 2009/0044336 A1 Feb. 19, 2009

(51) Int. Cl.
*A47G 9/04* (2006.01)
*A47G 9/02* (2006.01)

(52) U.S. Cl. ..... 5/486; 5/482

(58) Field of Classification Search ..... 5/486, 5/482, 502, 922, 923
See application file for complete search history.

(56) References Cited

U.S. PATENT DOCUMENTS

| | | | | | |
|---|---|---|---|---|---|
| 1,267,042 | A | | 5/1918 | Arnold | |
| 2,730,728 | A | | 1/1956 | Roberts | |
| 3,508,285 | A | | 4/1970 | Marquette | |
| 4,005,499 | A | | 2/1977 | Klein | |
| 4,573,227 | A | | 3/1986 | Prandina | |
| 4,631,765 | A | * | 12/1986 | Casey | 5/417 |
| 5,251,350 | A | * | 10/1993 | Bordenave et al. | 5/482 |
| 5,713,089 | A | | 2/1998 | Ferrante | |
| 6,226,814 | B1 | | 5/2001 | Alexander | |
| 6,311,347 | B1 | | 11/2001 | Limardi et al. | |
| 6,643,871 | B1 | | 11/2003 | Robke | |
| 6,862,760 | B2 | | 3/2005 | Bradley et al. | |
| 7,100,223 | B1 | | 9/2006 | Anthony | |
| 7,117,553 | B2 | * | 10/2006 | Fairchild et al. | 5/655 |
| 7,340,788 | B1 | * | 3/2008 | Traub | 5/697 |
| 2006/0059622 | A1 | | 3/2006 | Haggerty | |
| 2006/0282950 | A1 | | 12/2006 | Shuster et al. | |
| 2007/0061967 | A1 | | 3/2007 | Fox | |
| 2007/0226905 | A1 | * | 10/2007 | VanNeste | |

* cited by examiner

*Primary Examiner*—Alexander Grosz
(74) *Attorney, Agent, or Firm*—Thomas Wilhelm

(57) ABSTRACT

Bed clothing in panels which extend the length or width of the bed and which can be fastened together to make up bed cloths, and which can be fully separated from each other for laundering. Where the panels extend longitudinally in the bed, and the panels have effective widths of about 19 inches to about 23 inches, the panels can be used to make up bed clothing which fits all standard size beds within 10 inches of conventionally-used bed clothing widths. The panels can have adjustable widths (W) which enable the user to assemble a bed cloth to more closely approach the conventionally-used bed clothing widths. A longitudinally-extending panel can be segmented so as to be separable into two or more panel pieces along transversely-extending edges of the respective panel pieces.

4 Claims, 5 Drawing Sheets

PANELIZED BED CLOTHING SUSCEPTIBLE OF HOME LAUNDERING

BACKGROUND OF THE INVENTION

This invention relates to bed clothing, and especially to blankets, comforters, quilts and other bed covers. Beds come in at least four standard sizes, namely twin size, full size, queen size, and king size. Twin size beds and full size beds differ in width, though they have a common length. Similarly, queen size beds and king size beds differ in width, though they have a common length, different, though only modestly so, from the length of twin size beds and full size beds. These are the most common sizes, though there are others. Twin size beds and full size beds use bed clothing which is 86 inches long. Queen size beds and king size beds use bed clothing which is 90 inches long.

It is quite common for a given household to have more than one size of bed in the house. It is also quite common to maintain a variety of bed clothing for a given bed or plurality of beds of a common size so as to be able to change at least the top piece of bed clothing seasonally in order to use the bed clothing as part of a changing decorating theme.

A first issue for the homemaker is that use of each piece of bed clothing is limited to a single size of bed whereby separate sets of bed clothing must be maintained for each size of bed in the house.

A second issue faced by the homemaker is the cleaning of especially the thicker bed cloths such as quilts and comforters. Especially with the relatively larger bed sizes, blankets, quilts, and comforters are commonly so massive that such bed clothing items are not readily cleaned in conventional-size home laundry machines.

Thus, there is a need for cost-effective bed clothing products which can be universally fitted onto any standard size bed.

There is also a need for cost-effective bed clothing products which are readily susceptible of being cleaned in home laundry machines.

SUMMARY OF THE INVENTION

This invention provides bed clothing which can be used on, and properly fitted to, multiple sizes of beds, and which bed clothing can be readily laundered in conventional consumer residential laundry machines. First and second bed clothings of the invention can have first and second different print designs, whereby separate pieces of such bed clothing can be assembled together to make a single bed cloth having multiple and complementary designs and/or print patterns.

The basic concept of the invention is to provide bed clothing in longitudinally-extending panels which extend the length of the bed and which can be fastened together, in three to five panels to make up bed clothing useful on the standard size beds. Namely, either 3 panels, 4 panels, or 5 panels can be used to make up a bed cloth for any of the standard size beds. As a result, all of such bed clothing in the household is available, and usable, on any and all of the beds. Also, all of such bedding can be disassembled into relatively smaller panels which can be laundered by on-site residential-grade laundry machines; and can be subsequently stored in the disassembled condition.

In general, bed clothing of the invention is assembled for use on a particular bed by combining multiple bed clothing panels which are all the same width, and wherein the panels are sized such that any one panel can be combined with any two or more other panels thereby to make up bed clothing of suitable size to fit any standard size bed.

Suitable panel sizes are nominally about 86 inches to about 90 inches long and are nominally about 19 inches to about 23 inches wide. Using panels having the above dimensions, bed clothing can be assembled using 3-5 such panels, for use on any of the above-mentioned standard-size beds.

In some embodiments, a given longitudinally-extending panel has transverse separation joints whereby the respective panel can be further disassembled into additional panel pieces at the separation joints.

In some embodiments, where the assembled cloth has a length extending between the head end of the bed and the foot end of the bed, and a width extending transverse to the width of the bed cloth, the panels extend transversely of the length of the bed cloth, whereby the fastening structures extend transversely across the width of the bed cloth.

Figure 1:
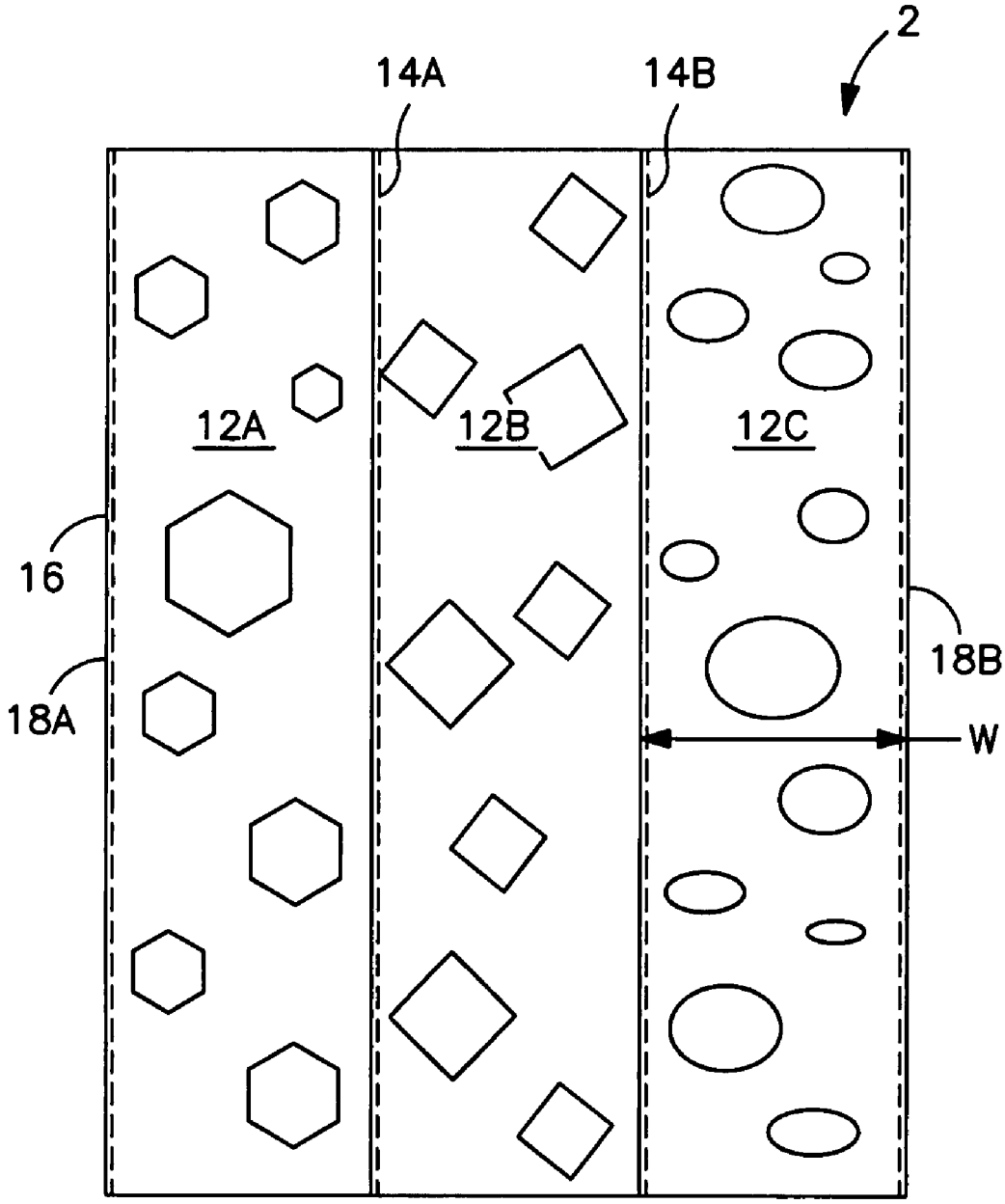
FIG. 1 shows a plan view of a 3-panel bed cloth of the invention.

The invention is not limited in its application to the details of construction, or to the arrangement of the components set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

As used herein "bed clothing" refers to the relatively bulky items which are placed on top of the typically-used bed sheets on a bed. Thus, bed clothing includes such bulky items as blankets, comforters, quilts, and the like, and does not include mattress pads, fitted sheets, or flat sheets. Where multiple layers of bed clothing items are used on a given bed at the same time, all such layers, including one or more layers below the top layer, can include bed clothing of the invention.

Figure 3:
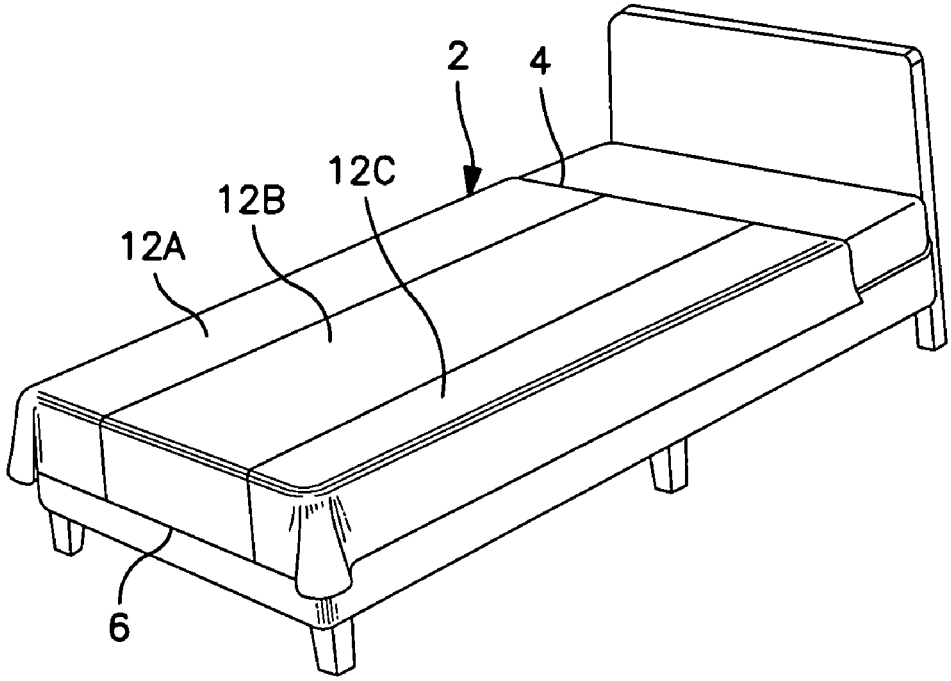
FIG. 3 is a pictorial view of a 3-panel bed cloth of the invention on a twin size bed.

Referring to FIGS. 1 and 3, a bed cloth 2 in the form of a comforter has a head end 4 and a foot end 6, and is assembled from 3 longitudinally-extending comforter panels 12A, 12B, and 12C, fastened together by longitudinally-extending zippers 14 and is used on a twin-size bed. A first zipper 14A fastens together panels 12A and 12B. A second zipper 14B fastens together panels 12B and 12C.

Figure 2:
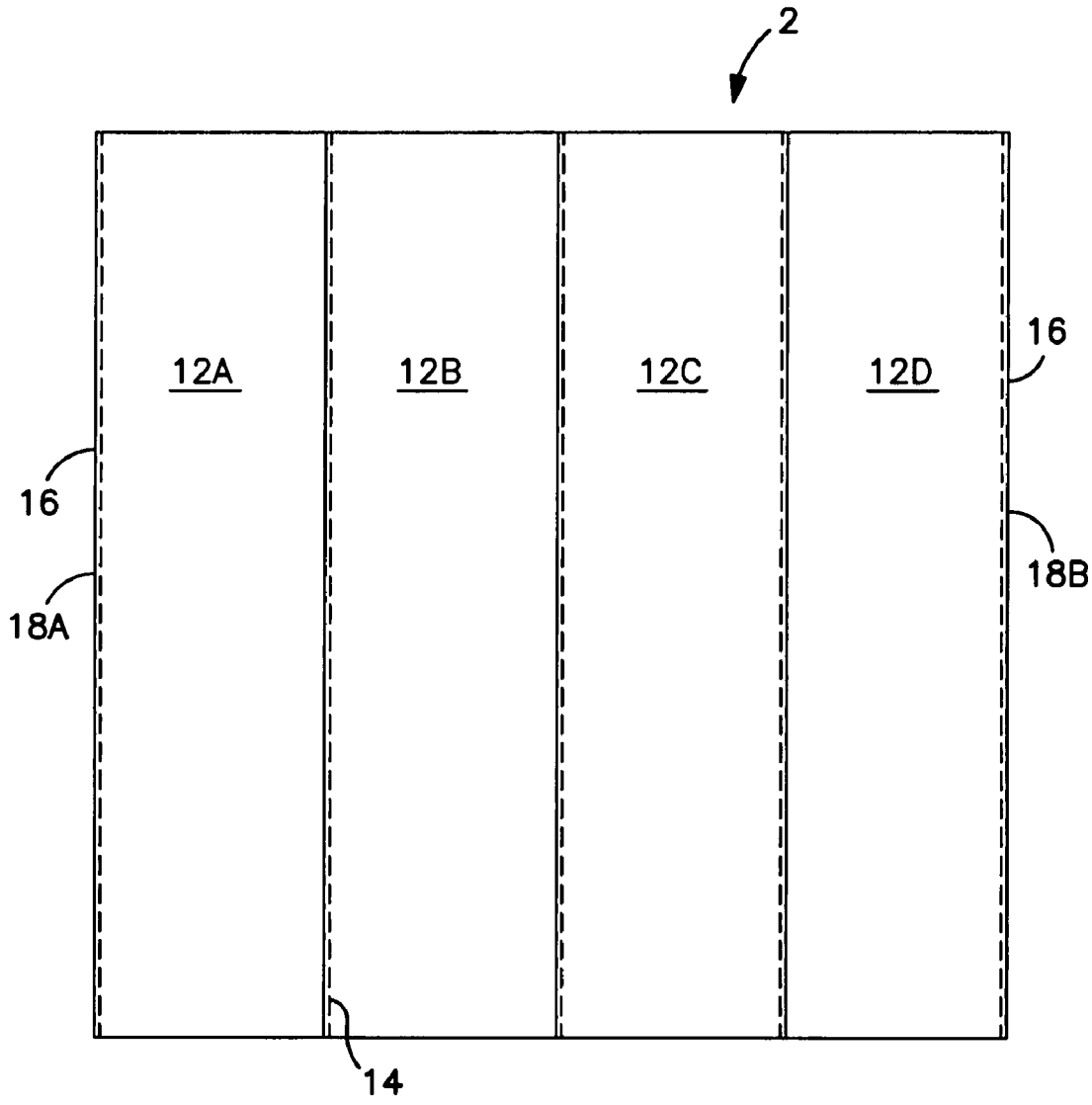
FIG. 2 shows a plan view of a 4-panel bed cloth of the invention.
Figure 4:
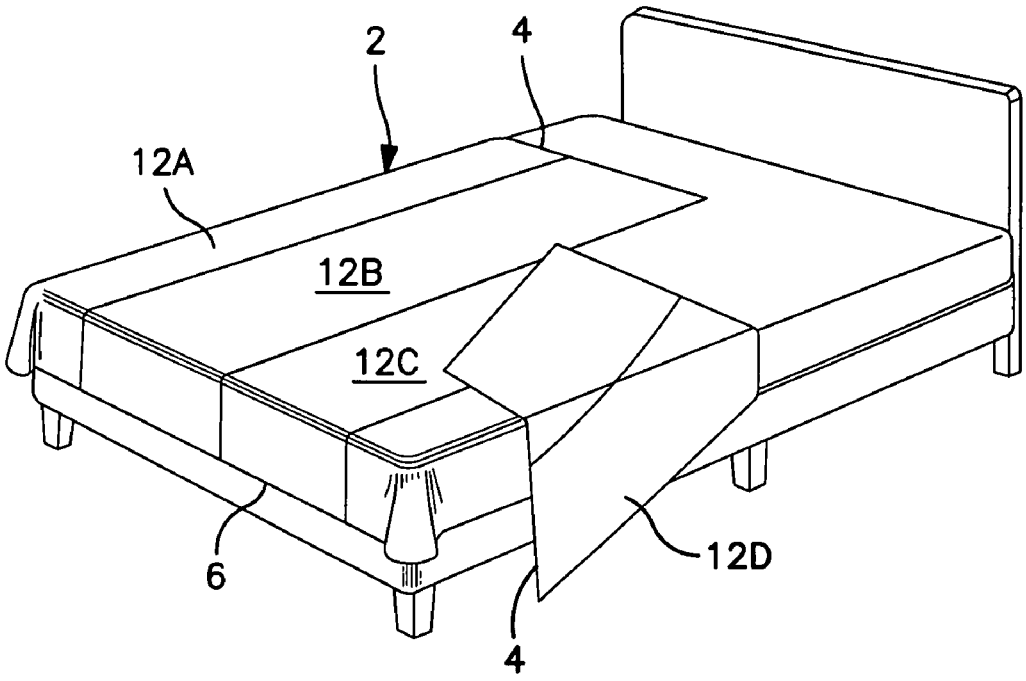
FIG. 4 is a pictorial view of a 4-panel bed cloth of the invention on a queen size bed.
Figure 5:
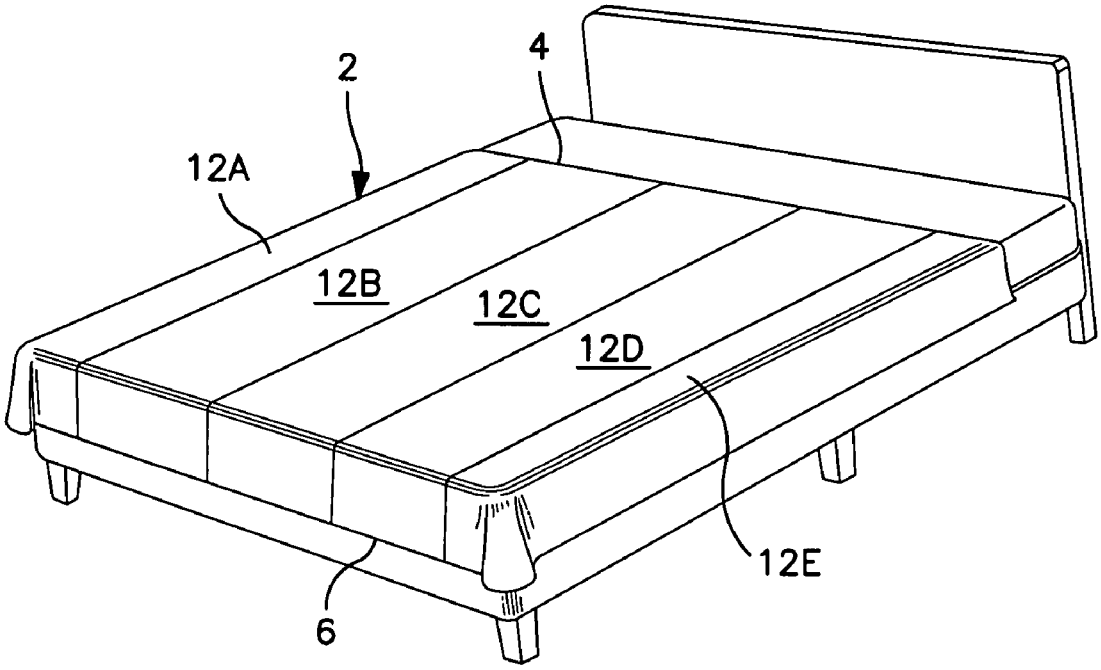
FIG. 5 is a pictorial view of a 5-panel bed cloth of the invention on a king size bed.

Four such panels can be used for making up a bed cloth for use on either a full-size bed or a queen-size bed as illustrated in FIGS. 2 and 4. Five panels can be used for making up a bed cloth for use on a king size bed as illustrated in FIG. 5. In FIGS. 1-5, the number of panels used for a given bed size is based on a panel width "W" of 21 inches.

The fastening system can be defined by fastening structures other than zippers. For example, there can be mentioned such other fastening structures as buttons, snaps, lacing, and hook and loop fasteners (e.g. Velcro®) at both longitudinal edges of the panels. Where male/female combinations are concerned as in buttons and button holes, or male and female snaps, one edge of each panel has male elements and the other edge has female elements. The male and female elements on the respective panels are arrayed such that the male and female elements on a given panel can be joined with corresponding male and female elements on an adjoining panel when the panels are aligned with each other longitudinally, side-by-side. In the alternative, both male and female elements can be arrayed along a given edge and correspondingly mating male and female elements are arrayed along respective edges of panels which are to be joined with that edge.

As desired, panel edge covering elements 16 can be used at the edges 18 of the respective panels 12 to cover the fastener structure, both for visual aesthetics and to present a softer, more pleasant tactile sensation to people who use the bed on which the assembled bed cloth is used.

Widths "W" of the panels 12 are critical to successfully and efficiently achieving some of the objectives of the invention. In some, but not all embodiments, all the panels are the same width "W". Where all the panels have the same width, the user can select the number of panels needed, selecting panels having desired aesthetic appearances, and ignoring panel width. Suitable widths for panels 12 are about 19 inches wide to about 23 inches wide. Table 1 shows that multiple panels, all the same effective width, can be used to create bed covers which approximate the conventional bedding widths commonly used for the 4 standard bed sizes. Thus, Table 1 shows conventionally-accepted bedding widths, as nominal bedding widths, as well as the number of panels of the respective panel widths which are assembled for each bed size, and the resulting widths of the respective bed clothing assemblies.

resultant widths are more than 10 inches different from the nominal width of 76 inches for a queen size bed.

The problem with the queen size bed is not solved by making a minor adjustment in the widths of the panels. For example, if the panel width is reduced modestly to 30 inches, the same problem exists with a full size bed. If the width is increased modestly to 33 inches, the full size bed is now accommodated within 10 inches, but the queen size bed is not accommodated within 10 inches of nominal width. Namely, for a queen size bed, 2 panels are 20 inches narrower than nominal, while 3 panels are 13 inches wider than nominal. Accordingly, a 2-panel structure for a twin-size bed, at about 30-32 inches width, does not achieve the desired result of a resultant width of the assembled clothing within 10 inches of the nominal widths for all standard sizes.

If the panels are narrower than the recited 19 inches, a greater number of panels need to be used with at least some of the bed sizes. Keeping in mind the fact that the fasteners add an increment to the cost of the overall bed clothing, any increase in the number of panels necessarily adds to the cost of the overall bed clothing assembly.

In addition, as additional panels need to be used, the process of assembling a bed cover for at least one bed size takes more time, as more panels need to be assembled to each other to make up the resultant bed cloth. Accordingly, panels narrower than 19 inches nominal width do not achieve the objectives of the invention.

Bed clothing of the invention is desirable because a soiled bed cloth, when removed from the bed for cleaning, can be disassembled as desired into pieces having less than all of the panels which are used on a given bed. Such disassembly facilitates laundering the bed clothing material in home laundry machines. Thus, a bed cloth having 3 panels might be laundered without disassembly, or 1 of the panels might be disassembled from the other 2 panels, or all three panels might be disassembled from each other, all according to the choice of the user. Similarly, a bed cloth having 4 panels, or 5

TABLE 1

| | | 19-inch Panels | | 20-inch Panels | | 21-inch Panels | | 22-inch Panels | | 23-inch Panels | |
|---|---|---|---|---|---|---|---|---|---|---|---|
| Bed Size | Nominal Bedding Width | No. Panels | Total Panel Width | No. Panels | Total Panel Width | No. Panels | Total Panel Width | No. Panels | Total Panel Width | No. Panels | Total Panel Width |
| Twin | 63 in. | 3 | 57 | 3 | 60 | 3 | 63 | 3 | 66 | 3 | 69 |
| Full | 76 in. | 4 | 76 | 4 | 80 | 4 | 84 | 3 | 66 | 3 | 69 |
| Queen | 86 in. | 5 | 95 | 4 | 80 | 4 | 84 | 4 | 88 | 4 | 92 |
| King | 102 in. | 5 | 95 | 5 | 100 | 5 | 105 | 5 | 110 | 4 | 92 |

As illustrated in Table 1, suitable panels, all being the same effective widths, can be assembled for use on any of the standard bed sizes using either 3 panels, 4 panels, or 5 panels, and wherein the resultant assembled bed cloths fit any standard size bed to within 10 inches of the conventionally-accepted nominal width.

If fewer than three panels are used for e.g. the twin size bed, the panel widths are so large that, for at least one bed size, the panels cannot be assembled into an acceptable overall width. For example, if only 2 panels are used, nominal panel width is about 31.5 inches to properly fit a twin size bed. The corresponding total widths for a queen size bed is either 63 inches with 2 panels or 94.5 inches with 3 panels, both of which panels, is typically disassembled into at least 2 pieces, optionally 3 pieces, 4 pieces, or 5 pieces, for laundering.

The degree of disassembling for laundry purposes depends in part on the size of the laundry machines which are to be used, as well as depending in part on the bulk of the bed clothing being addressed. In any event, with the panels no more than 23 inches wide, and susceptible of being fully disassembled from each other, all such bed clothing is susceptible of being laundered in conventional home laundry equipment after an appropriate degree of disassembly.

After the laundering process has been completed, the individual panels or panel assemblies can be stored without the panels having been reassembled to each other, whereby all such panels are readily available for assembly into a bed cloth of any desired size on an as-needed basis. In the alternative, the panels can, if and as desired, be re-assembled to each other, representative of one of the bed sizes, before being stored in preparation for the next use.

FIG. 1 illustrates the principle that the decoration, print pattern, on each of the panels can be different from the decoration, print pattern on the other ones of the panels. In FIG. 1, panel 12A illustrates a print pattern of isolated hexagons, while panel 12B illustrates a print pattern of isolated squares, and panel 12C illustrates a print pattern of isolated ellipses. Any print pattern can be used for any panel. In the alternative, all the panels on a given assembled bed cloth can represent a common pattern or image. Thus, the invention provides the capability to use the bed clothing as a decorating tool, whereby the user can not only select a bed cloth having a different decoration than the most recently used bed clothing, the user can take panels from e.g. short term storage and create an assembled bed cloth having a decorative presentation which represents different print patterns on respective ones of the corresponding panels.

For example, the user may purchase two different panelized bed clothing assemblies of the invention, each of which has a different print pattern, and/or weave pattern; disassemble the two different bed cloths, and re-assemble one or two desired bed clothing assemblies using panels from both of the originally-purchased bed clothing assemblies in each of the re-assembled bed cloths. The result is that the user has at least 4 decorating pattern options from having purchased only two panelized bed cloths of the invention.

Figure 6:
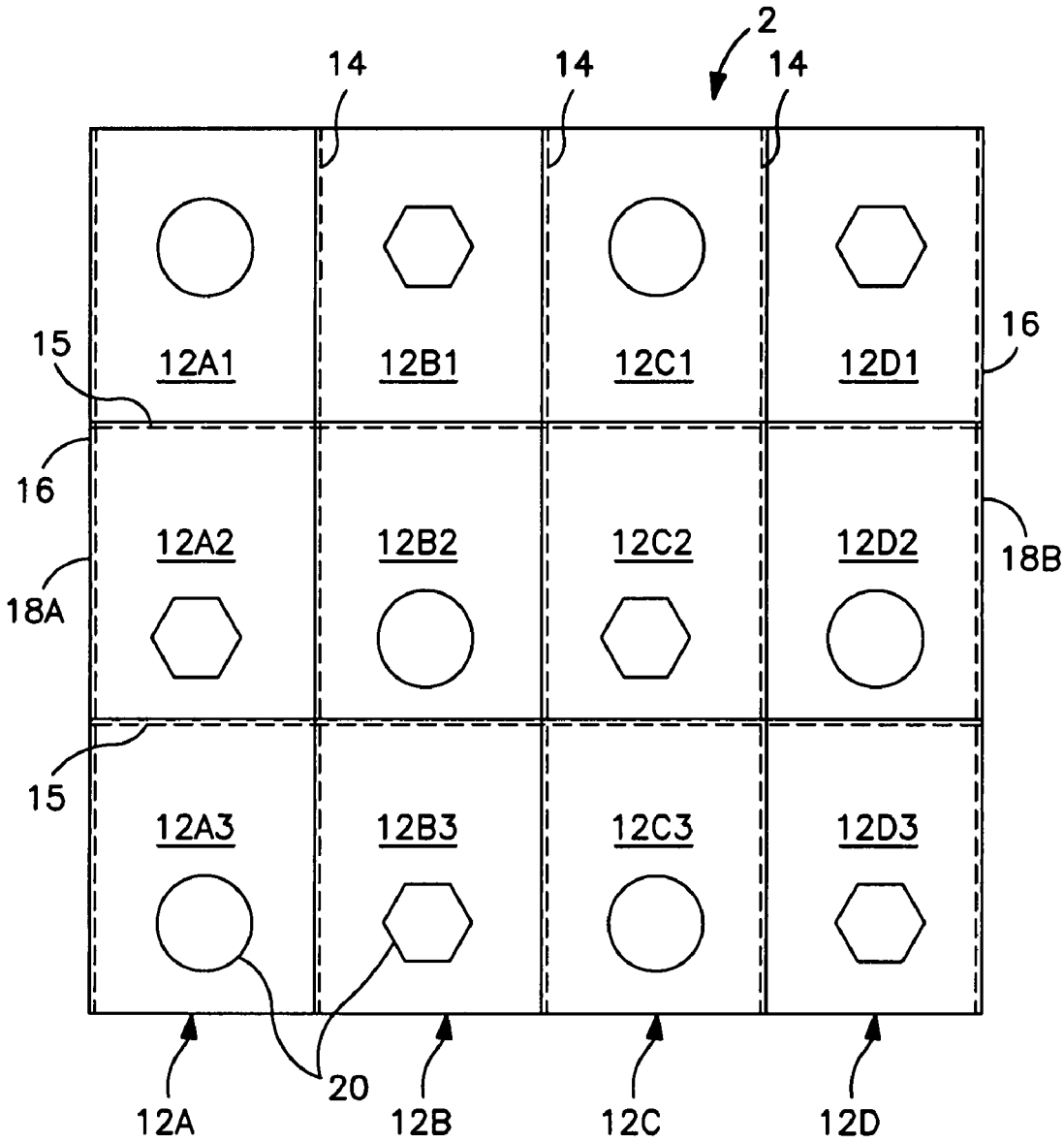
FIG. 6 shows a plan view of bed clothing of the invention which incorporates transverse internal edge joinings.

Still addressing decorating potential of bed cloths of the invention, FIG. 6 illustrates a bed cloth having three longitudinally-extending joints 14 and two transversely-extending joints 15. The combination of the three longitudinally-extending joints and the two transversely-extending joints define 12 panel pieces. Panel pieces 12A1, 12A2, and 12A3 define panel 12A. Panel pieces 12B1, 12B2, and 12B3 define panel 12B. Panel pieces 12C1, 12C2, and 12C3 define panel 12C. Panel pieces 12D1, 12D2, and 12D3 define panel 12D. Each such panel piece, in the illustrated embodiment, is the same size as all the other panel pieces. All of panels 12A, 12B, 12C and 12D have a common width "W".

Each such panel piece has fastener structure on all four sides of the respective piece, such that any piece can be fastened to any other piece on a corresponding edge. While the pieces are shown as being rectangular, with a dominant dimension, the pieces can as well be square.

The structures of the respective panel pieces can be defined by any repeating pattern such as squares, rectangles, triangles, other polygons, circles, and the like, or a combination of patterns, which enable randomly-selected pieces from the given population to be assembled to each other in a pattern, optionally a pattern which accepts any piece at any location in the pattern.

It is not necessary that the pieces, when assembled, provide a completely closed surface. Namely, in some embodiments, the assembled pattern can include one or more voids or apertures inside the outer perimeter of the finished assembled bed cloth, and which voids contain no fabric, no material. Such voids or apertures can be located at edges 14 or 15, or joints within a given panel or panel piece. For example, the circles and hexagons 20 illustrated in FIG. 6 can represent apertures extending through the panels.

Still referring to FIG. 6, the number of panel pieces is generally unlimited. Also the joint pattern need not include any straight longitudinally-extending joints. Indeed the outer perimeter can be somewhat irregular, and can, for example and without limitation, reflect a wandering or zigzagging longitudinally-extending joint pattern in the interior of the assembled bed cloth. For example, the panel pieces can be hexagonal in shape whereby the outer perimeter of the bed cloth can have a back and forth pattern reflective of such hexagonal shape.

Figure 7:
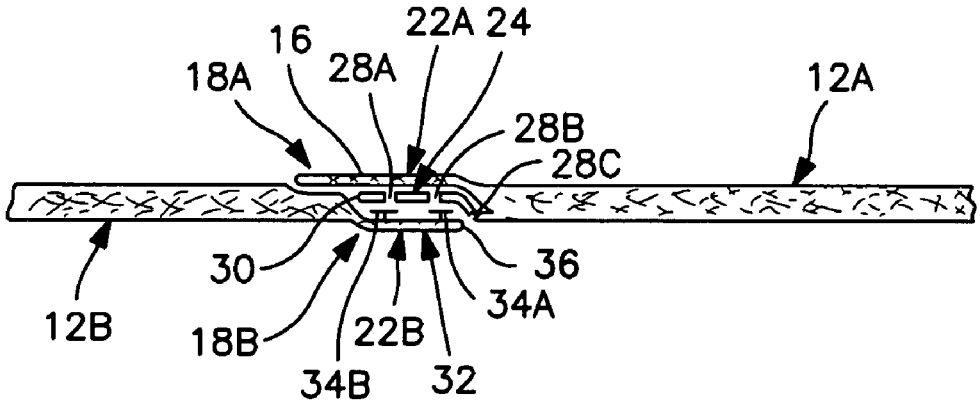
FIG. 7 shows a cross-section of edge portions of first and second bed clothing panels of the invention juxtaposed for fastening the edges of the panels to each other.

Table 1 shows that, for some of the panel widths, one of the assembled widths illustrated deviates from the standard "nominal bedding width" by as much as 10 inches. FIG. 7 illustrates another embodiment of edge structure of bedding panels of the invention. As illustrated, edge 18A terminates in a female portion 22A of a button fastening system.

Female portion 22A includes a button hole strip 24 and an edge cover 16. The button hole strip extends along the length of the panel and is mounted to the panel as part of the structure of edge 18A of panel 12A. The cover strip overlies the button hole strip 24. The button hole strip carries a first row 28A of button holes proximate the terminal edge 30 of the button hole strip. The first row of button holes extends along the length of the button hole strip, and along the longitudinal edge of panel 12A. A second row 28B of button holes is disposed further inwardly of the terminal edge, by about 2 inches from the first row of button holes. The second row, likewise, extends along the length of the button hole strip, and parallel to the first row of button holes, and is spaced from the longitudinal edge of the panel by the additional 2 inches. A third row 28C of button holes is disposed further inwardly of the terminal edge, by about 2 inches from the second row of button holes. The third row, likewise, extends along the length of the button hole strip, and parallel to the second row of button holes, and is spaced from the longitudinal edge of the panel by the additional 2 inches.

Male portion 22B includes a button strip 32. The button strip extends along the length of the panel and is part of the structure of edge 18B of panel 12B. Button strip 32 carries a first row 34A of buttons proximate the terminal edge 36 of the button strip. The first row of buttons extends along the length of the button strip and along the longitudinal terminal edge 36 of panel 12B. A second row 34B of buttons is disposed further inwardly of the terminal edge, by about 2 inches from the first row of buttons. The second row, likewise, extends along the length of the button strip, and parallel to the first row of buttons, and is spaced from the longitudinal edge 18B of panel 12B by the additional 2 inches.

The buttons and button holes are designed and configured such that the two panels, 12A and 12B, can be fastened to each other with sufficient security for use purposes by engaging a first row 34A or 34B of the buttons in a first row 28A or 28B or 28C of the button holes. Thus, the buttons of the first row 34A of buttons can be buttoned to any one of the rows 28A, 28B, or 28C of the button holes. With such flexibility of engagement of the buttons and button holes, the row of button holes to which a row of buttons is mounted can affect the effective width of a given panel by 4 inches. Adding the second row of buttons adds another 2-inch increment such that the effective width of the panel can be varied by as much as 6 inches at each longitudinally-extending joint. Thus, by using multiple rows of fasteners at the respective joints, the effective widths of the respective panels can be adjusted, which correspondingly adjusts the overall width of the bed clothing assembly, thereby to provide bed clothing assemblies having 3 panels, 4 panels, and/or 5 panels which are well within 5 inches of the nominal conventional bedding widths for all four standard sizes of bedding. Thus, the user can adjust the effective width of any panel at will, at any time, with resultant adjustment of the overall width of the respective resultant bed clothing assembly.

The phrase "effective width" of a panel means any width by which the respective panel extends the corresponding overall width, or length, as applies, of the corresponding bed clothing assembly by being attached to another panel at any of the attachment sites.

While panels 12 and panel pieces 12A, 12B, 12C, 12D have been described as having fastener structure 14 at both sides of the panel, or all sides of the panel piece, the panels or panel pieces which define the opposing sides and/or ends of the assembly can have such fastener structure on only the side or sides which fasten to another panel or panel piece.

The decorative appearance of each panel piece can be selected such that the assembled pieces present a desired aesthetic affect or appearance on the bed, and optionally contribute to the decorating theme of the respective room or suite.

Although the invention has been described with respect to various embodiments, it should be realized this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A bed cloth having a length and a width, and comprising at least three longitudinally-extending panels and no more than five longitudinally-extending panels, each said panel having a length defining first and second ends, and a width (W) defining first and second sides, each said panel comprising first fastener structure extending between the first and second ends at the first side, at least one of said longitudinally-extending panels further comprising second adjacent fastener structure extending between the first and second ends at the first side and displaced inwardly away from the first side relative to the first fastener structure, whereby the respective said longitudinally-extending panel can be joined to at least one of the other said longitudinally-extending panels at the second fastener structure, to achieve multiple effective widths of the respective said longitudinally-extending panel, wherein one of the fastener structures comprises a button hole strip having a longitudinal terminal edge with a first row of button holes proximate the terminal edge, a second row of button holes spaced inwardly from the first row of button holes by about two inches, and a third row of button holes spaced inwardly from the second row of button holes by about two inches;

the other of the fastener structures comprising a button strip having a longitudinal terminal edge with a first row of buttons proximate the terminal edge, and a second row of buttons spaced inwardly from the first row of buttons by about two inches, the buttons adapted to be releasably fastened to the button holes.

2. A bed cloth as in claim 1 wherein the second fastener structure extends parallel to the first fastener structure.

3. A bed cloth as in claim 1 wherein the effective widths of said longitudinally-extending panels are about 19 inches to about 23 inches.

4. A bed cloth as in claim 1 wherein the effective widths of said longitudinally-extending panels are about 20 inches to about 21 inches.

* * * * *